US010989410B2

(12) United States Patent
Chen

(10) Patent No.: US 10,989,410 B2
(45) Date of Patent: Apr. 27, 2021

(54) ANNULAR FREE-VORTEX COMBUSTOR

(71) Applicant: DYC Turbines, LLC, San Diego, CA (US)

(72) Inventor: Daih-Yeou Chen, San Diego, CA (US)

(73) Assignee: DYC Turbines, LLC, San Diego, CA (US)

( * ) Notice: Subject to any disclaimer, the term of this patent is extended or adjusted under 35 U.S.C. 154(b) by 168 days.

(21) Appl. No.: 16/282,370

(22) Filed: Feb. 22, 2019

(65) Prior Publication Data

US 2020/0271320 A1 Aug. 27, 2020

(51) Int. Cl.

| | |
|---|---|
| ***F23R 3/14*** | (2006.01) |
| ***F23R 3/12*** | (2006.01) |
| ***F23R 3/08*** | (2006.01) |
| ***F23R 3/16*** | (2006.01) |
| ***F23R 3/50*** | (2006.01) |

(52) U.S. Cl.

CPC ..... *F23R 3/14* (2013.01); *F23R 3/08* (2013.01); *F23R 3/12* (2013.01); *F23R 3/16* (2013.01); *F23R 3/50* (2013.01); *F23R 2900/00005* (2013.01)

(58) Field of Classification Search

CPC ..... F23R 3/08; F23R 3/12; F23R 3/14; F23R 3/46; F23R 3/50; F23R 3/283; F23R 3/286; F23R 2900/000005

See application file for complete search history.

(56) References Cited

U.S. PATENT DOCUMENTS

| | | | | |
|---|---|---|---|---|
| 3,834,159 A * | 9/1974 | Vdoviak | F23R 3/14 60/746 |
| 3,927,835 A * | 12/1975 | Gerrard | F23R 3/283 239/400 |
| 4,329,848 A * | 5/1982 | Caruel | F23R 3/08 60/757 |
| 4,404,806 A | 9/1983 | Bell, III et al. | |
| 5,394,688 A | 3/1995 | Amos | |

(Continued)

OTHER PUBLICATIONS

Ian Summerside†, Nicolas Demougeot, Jeffrey A. Benoit, "Low Emissions Combustion System Retrofits for Mature Frame Gas Turbine Power Plants," 15-IAGT-207, Oct. 2015 (Year: 2015).*

*Primary Examiner* — Scott J Walthour
*Assistant Examiner* — David P. Olynick
(74) *Attorney, Agent, or Firm* — Diana D. Brehob; Brehob Law, PLLC

(57) ABSTRACT

An annular combustor is disclosed in which free-vortices are generated which: enhance fuel air mixing, recirculate the air, provide cooling for the combustor walls, and provide low emissions and a substantially uniform exit temperature profile. The combustor is provided fuel and air through a plurality of fuel injectors which atomizes the fuel and promote individual vortices emanating from each injector. The combustor includes an annular prechamber, an annular main chamber, and an annular dilution zone. A first swirler is provided on the inner side of the annular prechamber and a second swirler on the outer side of the annular prechamber, the swirlers causing flow to rotate in mutually opposite directions to intensify the vortices imposed by the injectors. The vortices cause a pressure depression to promote some backflow that enhance mixing to: promote complete combustion, produce low emissions, and provide cooling.

19 Claims, 10 Drawing Sheets

(56) References Cited

U.S. PATENT DOCUMENTS

| | | | | |
|---|---|---|---|---|
| 5,540,056 | A | 7/1996 | Heberling et al. | |
| 5,628,192 | A * | 5/1997 | Hayes-Bradley | F23R 3/286 60/733 |
| 6,151,899 | A | 11/2000 | Park | |
| 6,955,053 | B1 | 10/2005 | Chen et al. | |
| 7,302,801 | B2 | 12/2007 | Chen | |
| 8,316,645 | B2 | 11/2012 | Lee et al. | |
| 9,869,251 | B2 | 1/2018 | Chen | |
| 2013/0047621 | A1 * | 2/2013 | Carrere | F23R 3/54 60/752 |
| 2019/0003711 | A1 * | 1/2019 | Reynolds | F23R 3/60 |

* cited by examiner

ANNULAR FREE-VORTEX COMBUSTOR

FIELD

The present disclosure relates to continuous combustors.

BACKGROUND

Continuous combustors are well known in the industry, particularly in the field of gas turbines. There continues to be a need for an inexpensive combustor with low emissions. Furthermore, there is a need for an inexpensive combustor that is scalable to greater output sizes.

SUMMARY

An annular combustor is disclosed that is inexpensive and has the advantage of being scalable from including one injector to multiple injectors. Free vortices are generated within the combustor which enhance mixing thereby improving combustion in terms of more complete combustion and low emission production.

An annular combustor is disclosed that includes: an injector annulus with a plurality of holes with a plurality of injectors, one of the plurality of injectors inserted into each of the plurality of holes in the injector annulus. A first air inlet ring is coupled between an inner surface of the injector annulus and an inner liner. A second air inlet ring is coupled between an outer surface of the injector annulus and an outer liner. The first air inlet ring has a plurality of deflectors that direct flow of air passing therethrough to swirl in a particular rotational sense. The second air inlet ring has a plurality of elements that direct flow of air passing therethrough to swirl in an opposite sense to the particular rotational sense of the first air inlet ring.

A volume included between the inner liner and outer liner has: an annular prechamber located immediately downstream of the plurality of fuel injectors; an annular main chamber located immediately downstream of the annular prechamber; and an annular dilution zone located immediately downstream of the annular main chamber.

An annular prechamber is defined by a prechamber portion of the inner liner and a prechamber portion of the outer liner. The prechamber portion of the inner liner comprises a first cylindrical wall with a first frustum coupled to a downstream end of the first cylindrical wall. Diameter of the first frustum decreases in the downstream direction. The prechamber portion of the outer liner comprises a second cylindrical wall with a second frustum coupled to a downstream end of the first cylindrical wall. Diameter of the second frustum increases in the downstream direction.

The annular combustor may further include: a first plurality of orifices defined in the first frustum arranged evenly around the circumference of the first frustum and a second plurality of orifices defined in the second frustum arranged evenly around the circumference of the second frustum.

An annular main chamber is located immediately downstream of the annular prechamber. The annular main chamber is defined by a main chamber portion of the inner liner and a main chamber portion of the outer liner. The main chamber portion of the inner liner has a third cylindrical wall with a third frustum coupled to a downstream end of the third cylindrical wall. Diameter of the third frustum increases in the downstream direction. The main chamber portion of the outer liner has a fourth cylindrical wall with a fourth frustum coupled to a downstream end of the fourth cylindrical wall. Diameter of the fourth frustum decreases in the downstream direction. The annular combustor also may include a third air inlet ring coupled between the prechamber and main chamber portions of the inner liner and a fourth air inlet ring coupled between the prechamber and main chamber portions of the outer liner. The third air inlet ring directing flow therethrough in the particular rotational sense and the fourth air inlet ring directing flow therethrough in an opposite sense of the particular rotational sense.

The main chamber portion of the inner liner further may also include a fifth cylindrical wall coupled to a downstream end of the third frustum. The main chamber portion of the outer liner includes a sixth cylindrical wall coupled to a downstream end of the fourth frustum. A first plurality of orifices is defined in the third frustum and arranged evenly around the circumference of the third frustum. A second plurality of orifices is defined in the fourth cylindrical wall and arranged evenly around the circumference of the fourth cylindrical wall.

The inner liner has prechamber wall, main chamber wall, and dilution zone wall portions. The outer liner has prechamber wall, main chamber wall, and dilution zone wall portions. An annular prechamber of the combustor is defined by an outer surface of the prechamber wall of the inner liner and an inner surface of the prechamber wall of the outer liner. An annular main chamber of the combustor is defined by an outer surface of the main chamber wall of the inner liner and an inner surface of the main chamber wall of the outer liner. An annular dilution zone of the combustor is defined by an outer surface of the dilution zone wall of the inner liner and an inner surface of the dilution zone wall of the outer liner. The annular combustor further includes: a third air inlet ring coupled between the prechamber and main chamber portions of the inner liner, a fourth air inlet ring coupled between the prechamber and main chamber portions of the outer liner, a fifth air inlet ring coupled between the main chamber and dilution zone portions of the inner liner, and a sixth air inlet ring coupled between the main chamber and dilution zone portions of the outer liner.

A downstream section of the annular prechamber increases in cross-sectional area as considered in a downstream direction. A downstream section of the annular main chamber decreases in cross-sectional area as considered in a downstream direction. A first plurality of circumferentially-arranged orifices is defined in the prechamber wall portions of the inner and outer liners. A second plurality of circumferentially-arranged orifices is defined in the main chamber wall portions of the inner and outer liners.

The annular combustor also has a combustor housing having a plurality of openings to accept injectors. The inner and outer liners are mounted within the housing. Passages are provided for incoming inlet air. The passages are defined: by inner surfaces of the housing and inner surfaces of the inner liner; and by inner surfaces of the housing and outer surfaces of the outer liner.

The annular combustor also includes a mechanical spring disposed between each injector and the injector annulus.

The annular combustor also has a connector coupled to the downstream edge of the prechamber that mates with a connector coupled to an upstream edge of the main chamber; and a connector coupled to the downstream edge of the main chamber that mates with a connector coupled to an upstream edge of the dilution zone.

The deflectors are one of blades and orifices with a centerline of the orifices canted with respect to a centerline of the combustor.

Also disclosed in an annular combustor that has an injector annulus with a plurality of holes. A plurality of injectors, one of the plurality of injectors inserted into each of the plurality of holes in the injector annulus. An annular prechamber is located downstream of the injector annulus, the annular prechamber being defined between an inner liner and an outer liner. An annular main chamber is located downstream of the annular prechamber, the annular main chamber being defined between the inner liner and the outer liner. A first air inlet ring is coupled between an inner surface of the injector annulus and an outer surface of a portion of the inner liner associated with the annular prechamber. A second air inlet ring is coupled between an outer surface of the injector annulus and an inner surface of a portion of the outer liner associated with the annular prechamber. A third air inlet ring is coupled between an inner surface of the inner liner associated with the annular prechamber and an outer surface of a portion of the inner liner associated with the annular main chamber. A fourth air inlet ring is coupled between an outer surface of the outer liner associated with the annular prechamber and an inner surface of a portion of the outer liner associated with the annular main chamber. The first and third air inlet rings each have a plurality of deflectors that direct flow of air passing therethrough to swirl in a particular rotational direction. The second and fourth air inlet rings have a plurality of deflectors that direct flow of air passing therethrough to swirl in an opposite direction to the particular rotational direction of the first and third air inlet rings.

The annular combustor has a plurality of orifices defined in the inner liner associated with the annular prechamber, a plurality of orifices defined in the outer liner associated with the annular prechamber, a plurality of orifices defined in the inner liner associated with the annular main chamber, and a plurality of orifices defined in the outer liner associate with the annular main chamber.

The annular combustor has an annular combustor housing having a plurality of openings into which the injectors are inserted. The inner and outer liners are mounted within the annular housing. Passages are provided for incoming inlet air. The passages are defined by inner surfaces of the annular housing and inner surfaces of the inner liner and are defined by outer surfaces of the annular housing and outer surfaces of the outer liner.

The combustor further includes an annular dilution zone located downstream of the annular main chamber.

The inner liner has an inner prechamber wall that partially defines the annular prechamber, an inner main chamber wall that partially defines the annular main chamber, and an inner dilution zone wall that partially defines the annular dilution zone. The outer liner has an outer prechamber wall that partially defines the annular prechamber, an outer main chamber wall that partially defines the annular main chamber, and an outer dilution zone wall that partially defines the annular dilution zone. The inner prechamber wall includes a first cylindrical wall with a first frustum coupled to a downstream end of the first cylindrical wall; and the outer prechamber wall includes a second cylindrical wall with a second frustum coupled to a downstream end of the first cylindrical wall. The combustor has an ignitor inserted therein to access one of the annular main chamber and the annular prechamber.

The combustor also includes: a fifth air inlet ring disposed between an inner surface of the inner liner associated with the annular main chamber and an outer surface of a portion of the inner liner associated with the annular dilution zone and a sixth air inlet ring coupled between an outer surface of the outer liner associated with the annular main chamber and an inner surface of a portion of the outer liner associated with the annular dilution zone. The fifth inlet ring has a plurality of deflectors that direct flow of air passing therethrough to swirl in a particular rotational direction. The sixth air inlet ring has a plurality of deflectors that direct flow of air passing therethrough to swirl in the opposite direction to the particular rotational direction.

In some embodiments, the deflectors are orifices having a centerline that is canted with respect to a centerline of the combustor. In other embodiments, the deflectors are blades.

The prechamber portion of the inner liner includes a first cylindrical wall with a first frustum coupled to a downstream end of the first cylindrical wall. Diameter of the first frustum decreases as considered in a downstream direction. The prechamber portion of the outer liner has a second cylindrical wall with a second frustum coupled to a downstream end of the second cylindrical wall. Diameter of the second frustum increases in the downstream direction. The main chamber portion of the inner liner has a third cylindrical wall with a third frustum coupled to a downstream end of the third cylindrical wall. Diameter of the third frustum increases in the downstream direction. The main chamber portion of the outer liner has a fourth cylindrical wall with a fourth frustum coupled to a downstream end of the fourth cylindrical wall. Diameter of the fourth frustum decreases in the downstream direction.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
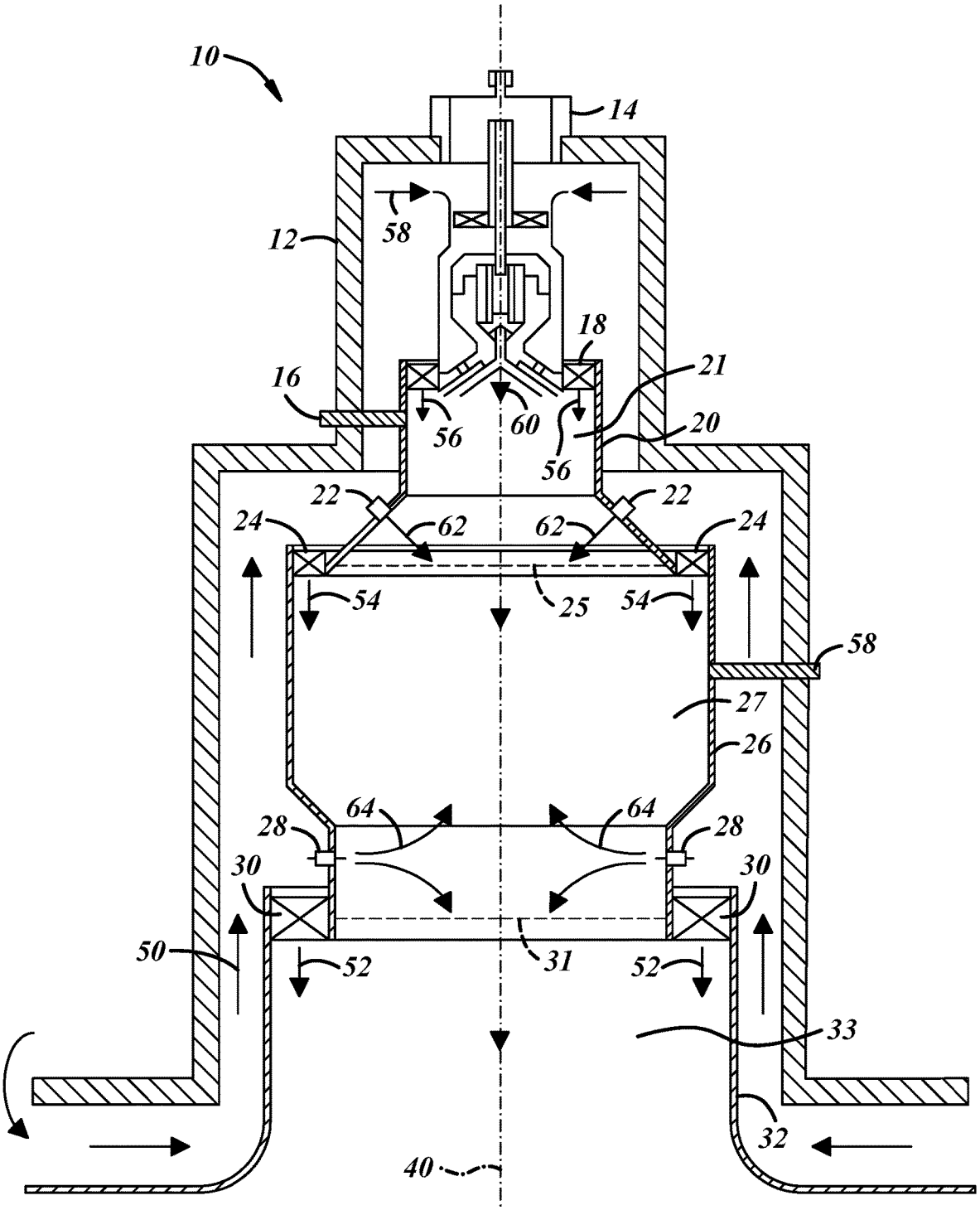
FIGS. 1-3 are cross-sections of embodiments of single combustors.

A cross section of a single continuous combustor 10 is shown in FIG. 1. Combustor 10 has a combustor case or combustor housing 12. An injector 14 is disposed in an upper end of combustor housing 12. In some embodiments, injector 14 is of the type taught in U.S. Pat. No. 9,869,251, which is incorporated by reference in its entirety. Alternatively, any suitable injector may be used. Injected fuel 60 is emitted from injector 14. Injector 14 is collinear with a center line 40 of the combustor housing 12. Coupled at the downstream end of injector 14 is an air inlet ring 18. Air inlet ring 18 is coupled to a prechamber wall 20. Prechamber wall 20 has a plurality of orifices 22 for inducting air. An air inlet ring 24 is coupled between prechamber wall 20 and a main chamber wall 26. Main chamber wall 26 has a plurality of orifices 28 for inducting air. An air inlet ring 30 is located between main chamber wall 26 and a dilution zone wall 32.

A prechamber 21 is partially defined by prechamber wall 20 and injector 14. A main chamber 27 is partially defined by main chamber wall 26. And, a dilution zone 33 is partially defined by a dilution zone wall 32. Prechamber 21 is loosely defined on a downstream end by a plane 25 through air inlet ring 24 and which is perpendicular to central axis 40. Plane 25 loosely defines main chamber 27 on an upstream end of main chamber 27. On a downstream end of main chamber 27, a plane 31, which goes through air inlet ring 30 and is perpendicular to central axis 40, also loosely defines main chamber 27.

FIG. 1 shows an ignitor 16 that has a tip that is in communication with prechamber 21. Ignitor 16 pierces through combustor housing 12 and prechamber wall 20. Ignitor 16 is typically used to initiate combustion during a start-up process of combustor 10. After successful ignition, ignitor 16 is deactivated. In FIG. 1, a face of ignitor 16 is flush with an inside surface of prechamber wall 20. Such configuration prevents disruption of the flow characteristics within prechamber 21. In other embodiments, ignitor 16 extends into prechamber 21. In yet other embodiments, ignitor 16 is retractable and is pulled back after ignition. In some embodiments, an ignitor 58 is located in main chamber wall 26.

Air flow 50 passes between an interior surface of combustor housing 12 and an exterior surface of walls 20, 26, and 32. Some of air flow 50 is inducted into dilution zone 33 through air inlet ring 30, as indicated by arrows 52. Another portion of air flow 50 is inducted into main chamber 27 through orifices 28. Such air flow is shown by arrows 64. Additionally, a portion of air flow 50 is inducted through air inlet ring 24 as shown by arrows 54 and through orifices 22 as indicated by arrows 62 into prechamber 21. A portion of air flow 50 is inducted through air inlet ring 18 as shown by arrows 56.

Figure 2:
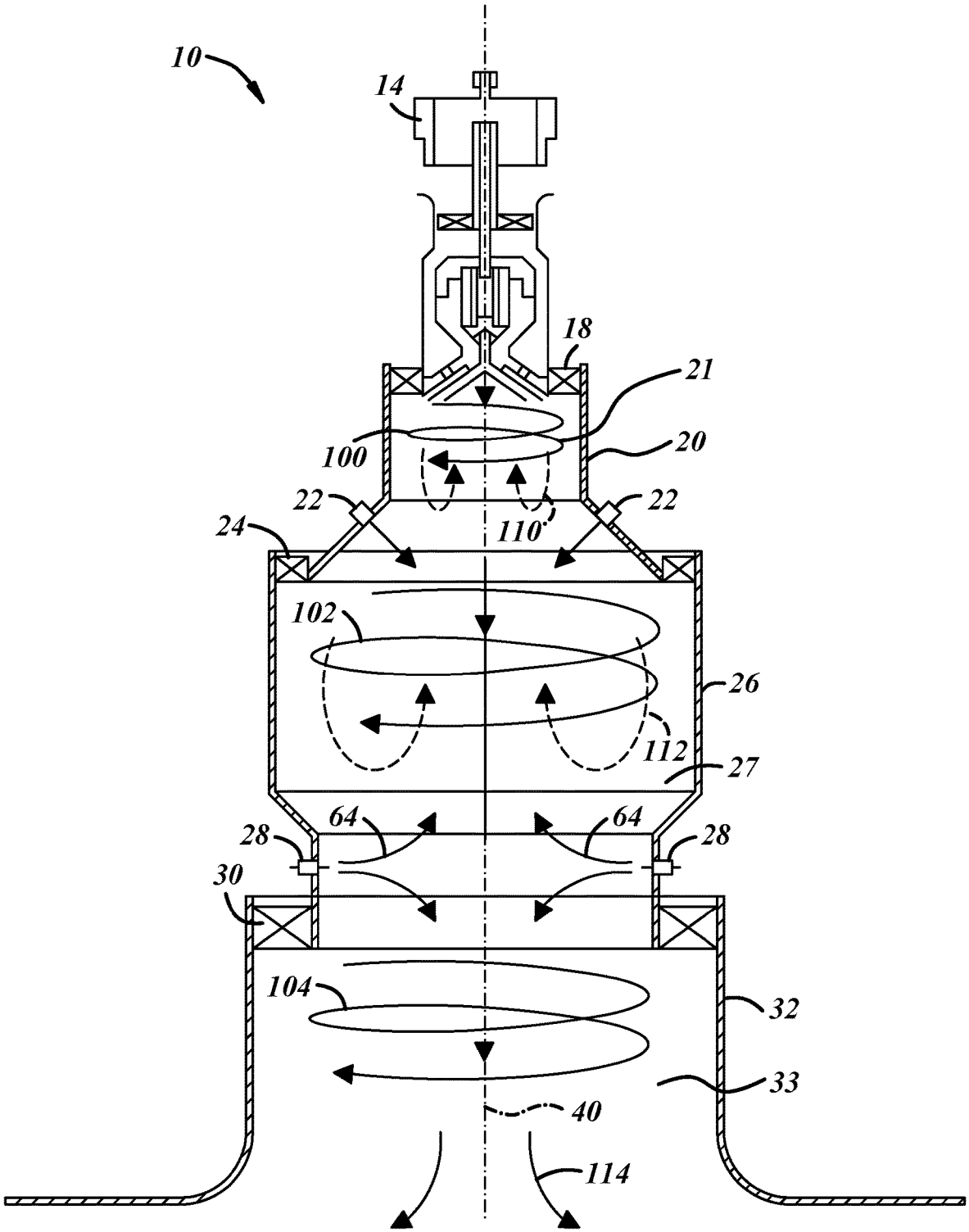

In some embodiments air inlet rings 18, 24, and 30 have blades that direct the air flow into a swirling flow. Such swirlers are discussed in more detail below. In embodiments where air inlet ring 18 is a swirler, a vortex 100 is set up in prechamber 21, as illustrated in FIG. 2. Flow within prechamber 21 is moving downward, although with a vortical movement; thus vortex 100 is shown as a helix. Vortex 100 causes a slight pressure depression along central axis 40 which causes some of the flow in vortex 100 to roll up as shown by dashed arrows 110. Such backward flow as shown by arrows 110 greatly improves mixing and combustion of the fuel and air in prechamber 21.

In some embodiments, a plurality of orifices 22 are formed around the periphery of prechamber wall 20. Orifices 22 are arranged so that the air flowing through them is not directed to the center, instead more tangent to the prechamber wall 20, in a direction that strengthens vortex 100.

Air is also inducted through air inlet ring 24 into main chamber 27. In embodiments where air inlet ring 24 is a swirler, air inlet ring 24 causes the flow to enhance vortex 100 which persists into main chamber 27. The resulting vortex 102 is illustrated as helix because the flow moves downward to dilution zone 33. A pressure depression near center line 40 of main chamber 27 causes some roll up of the flow as shown by arrows 112 which enhance mixing in main chamber 27.

More air is inducted through orifices 28 formed in main chamber wall 26. These orifices can be placed around the periphery of main chamber wall 26 and oriented to enhance vortex 102. In some embodiments, an ignitor 58 is installed in main chamber wall 26.

Continuing to refer to FIG. 2, air is inducted through another air inlet ring 30, which when a swirler, further adds to vortical motion of vortex 102. Such vortical flow of vortex 104 is illustrated as a helix in dilution zone 33. Due to the high amount of flow through dilution zone 30, no substantial roll up flow is formed. Flow 114 from dilution zone 33 exits combustor 10. In a gas turbine application, flow 114 is inducted into a stator upstream of a turbine.

Figure 3:
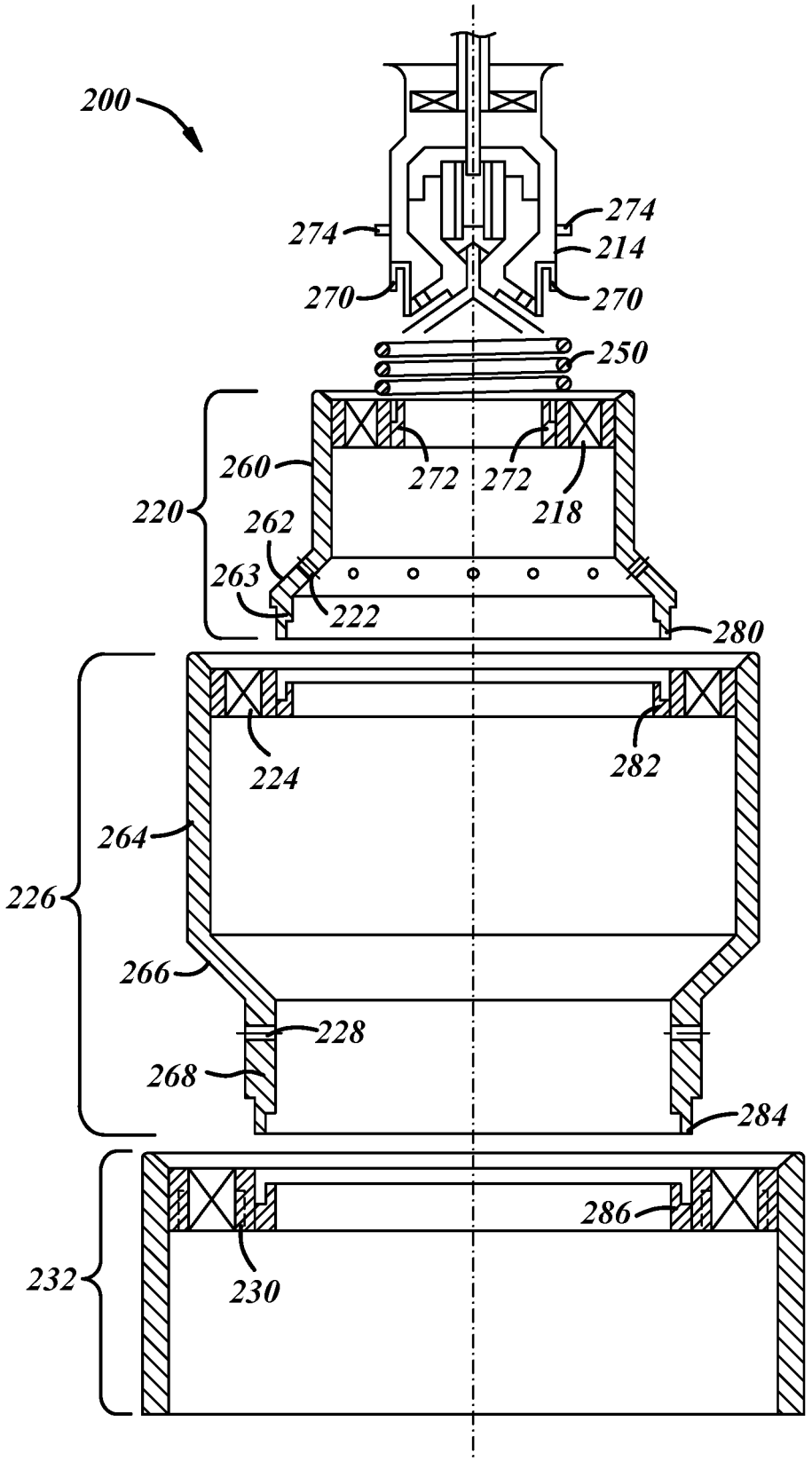

An exploded view of a combustor 200 is shown in FIG. 3. An injector 214 is pressed onto an air inlet ring 218 with a mechanical spring 250 disposed there between. Air inlet ring 218 is coupled to a prechamber wall 220 that includes a cylindrical portion 260, a frustum portion 262 that is downstream of the cylindrical portion, and a cylindrical portion 263 downstream of frustum portion 262. The diameter of cylindrical portion 260 is of a smaller diameter than the diameter of cylindrical portion 263. A plurality of orifices 222 are defined in the frustum portion 262 of prechamber wall 220. The orifices are formed in the wall in a manner to add to the vortex set up by air inlet ring 218.

Frustum portion 262 of prechamber wall 220 engages with an air inlet ring 224. Air inlet ring 224 is coupled to a main chamber wall 226. Main chamber wall 226 includes three sections, from upstream to downstream: a cylindrical portion 264, a frustum portion 266, and a cylindrical portion 268. The diameter of cylindrical portion 268 is smaller than the diameter of cylindrical portion 264.

Cylindrical portion 268 of main chamber wall 226 engages with an air inlet ring 230. Air inlet ring 230 engages with a dilution zone wall 232. Air inlet ring 230 has a lip 286 that engages with a groove 284 in main chamber wall 226. A lip 282 on air inlet ring 224 engages with a groove 282 in the downstream end of prechamber 220.

In FIG. 3, air inlet ring 218 is shown coupled to prechamber 220, possibly by welding or any other suitable fastening technique. Alternatively, air inlet ring and 218 could couple to prechamber 220 via a groove and lip fastener system similar to 280 and 282. One of the difficulties in a combustor is uneven expansion of the various elements, particularly during starting and warmup of the device. The reason for the free-floating joints and mechanical spring 250 pushing them joints together is to accommodate a small amount of relative movement without stressing the components that are coupled together. A solid connection could lead to high stresses developing and premature failure. Joints in the system could be any suitable joint type that allows some relative movement of the abutting elements. Some of the joints that have less relative movement are solidly coupled via a weld or other bond. Although not shown in FIG. 3, two end pieces of the combustion (injector 214 and dilution zone wall 232) are held fixed. When injector 214, dilution zone wall 232, and all the pieces between expand, the spring compresses to hold them together more tightly. Mechanical spring 250 is shown between injector 214 and air inlet ring 218. When assembled, mechanical spring abuts a ring 274 that extends outwardly from injector 214 and air inlet ring 218. Injector 214 couples to prechamber 220 when connector 270 engages with connector 272 during assembly. In other embodiments, a mechanical spring is provided at a different junction in the combustor. In even other embodiments, a plurality of joints in the combustor are provided with mechanical compression springs. In yet even other embodiments, a tension spring is used between the two end pieces (injector 214 and dilution zone wall 232) to pull them together, which pulls all the free-floating joints in the system to pull together.

Figure 4:
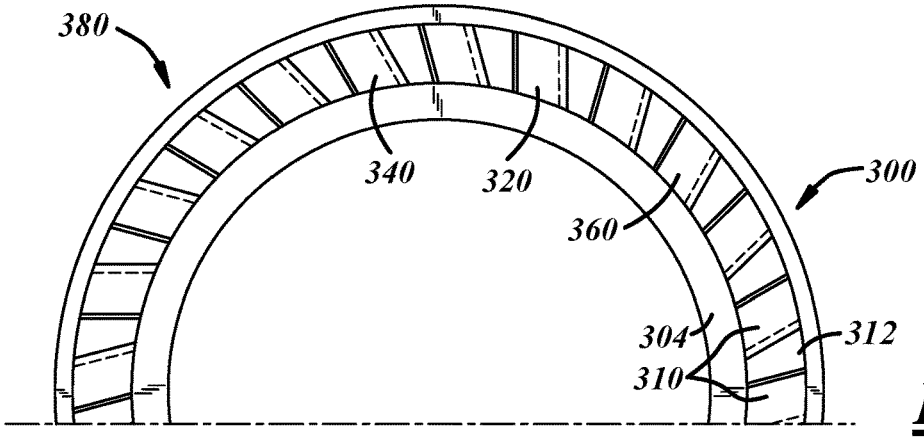
FIGS. 4 and 5 are plan and isometric views of a blade-type swirler, respectively.

An embodiment of an air inlet ring 300 that swirls the flow (a swirler) is shown in FIG. 4. Air inlet ring 300 has an outer wall 302 and an inner wall 304 with blades that extend between walls 302 and 304. Between adjacent blades 310 is an opening 312.

Figure 5:
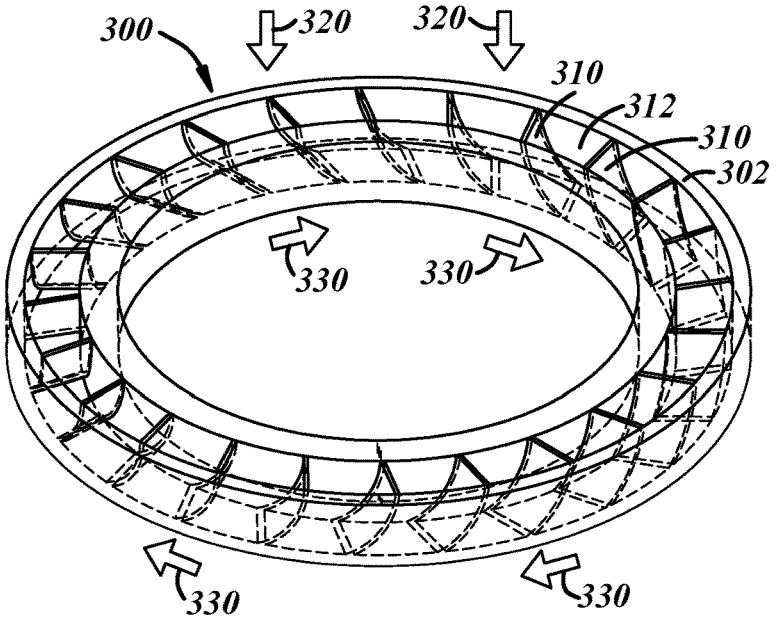

An isometric view of inlet ring 300 is shown in FIG. 5. The curvature of blades 310 disposed between walls 302 and 304 is visible. Between adjacent blades 310 are openings 312. A swirling flow 330 is imparted to downward inlet air flow 320 due to blades 310 guiding the flow.

Figure 6:
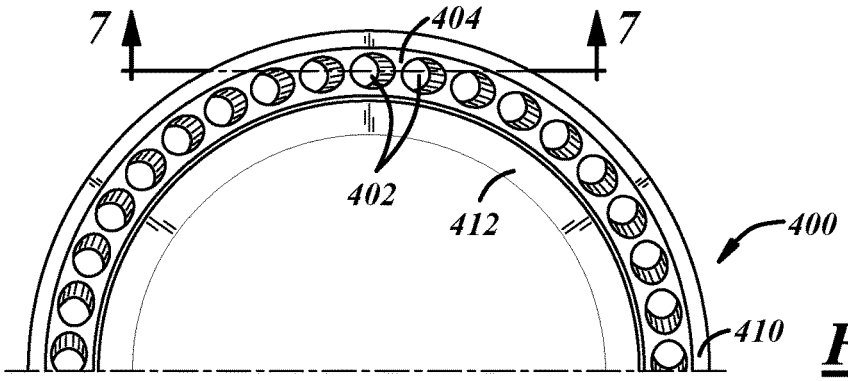
FIGS. 6 and 7 are plan and side views of sections of an orifice-type swirler, respectively.
Figure 7:
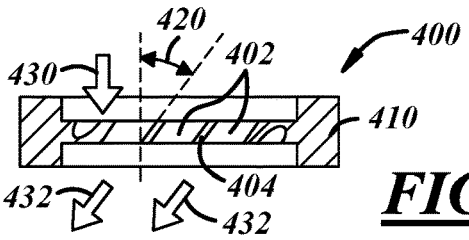

An alternative air inlet ring 400 that swirls the flow is shown in FIG. 6. Air inlet ring 400 has an outer wall 410 and an inner wall 412 with a plurality of orifices 402 defined in the web material between walls 410 and 412. Bridges 404 are between adjacent orifices 402. A cross section 7-7 of FIG. 6 is shown in FIG. 7, where angle 420 indicates the angle with which orifices 402 are canted with respect to the direction of incoming flow 430. Outlet flow from air inlet ring 400 has a swirling component as illustrated by arrows 432. The canted orifices of FIGS. 6 and 7 or the blades of FIGS. 4 and 7 are collectively called deflectors herein.

Figure 8:
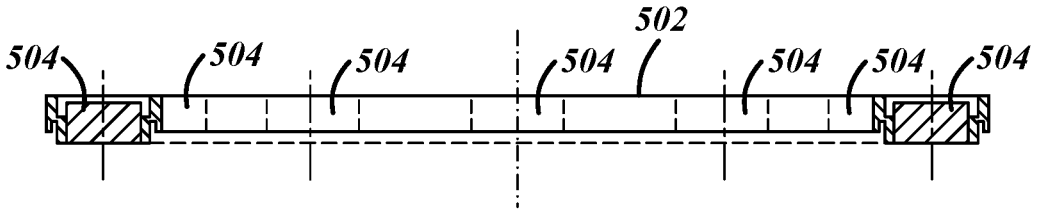
FIG. 8 is a side view of a section of an injector annulus.
Figure 9:
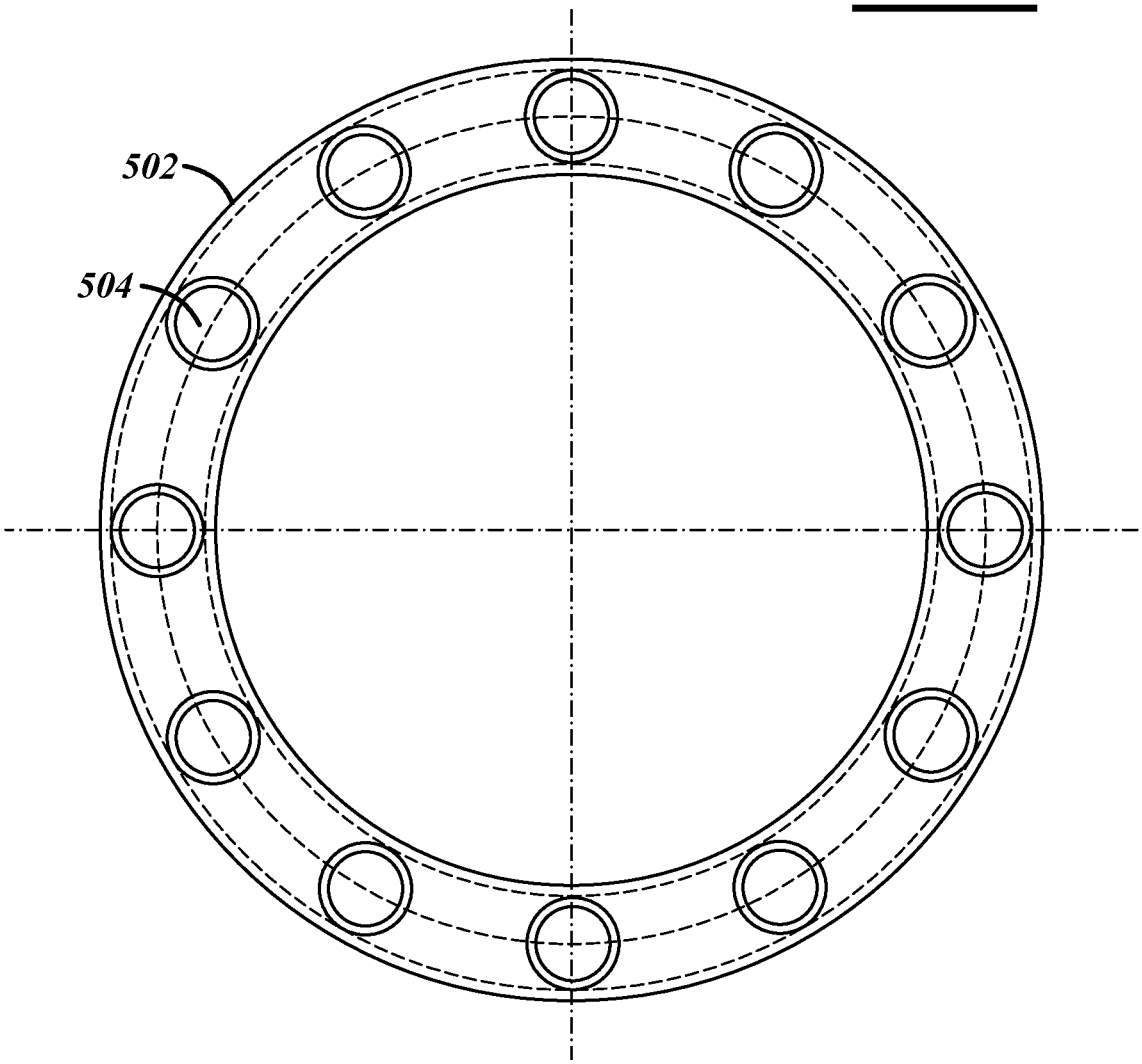
FIG. 9 is a plan view of the injector annulus.

The discussion above is directed to a combustor with a single injector. When desiring a higher output than such a combustor can provide, one alternative would be to scale everything larger. In another alternative, multiple injectors are arranged annularly. An injector annulus 502 that has holes 504 for twelve injectors is shown in FIGS. 8 and 9.

Figure 10:
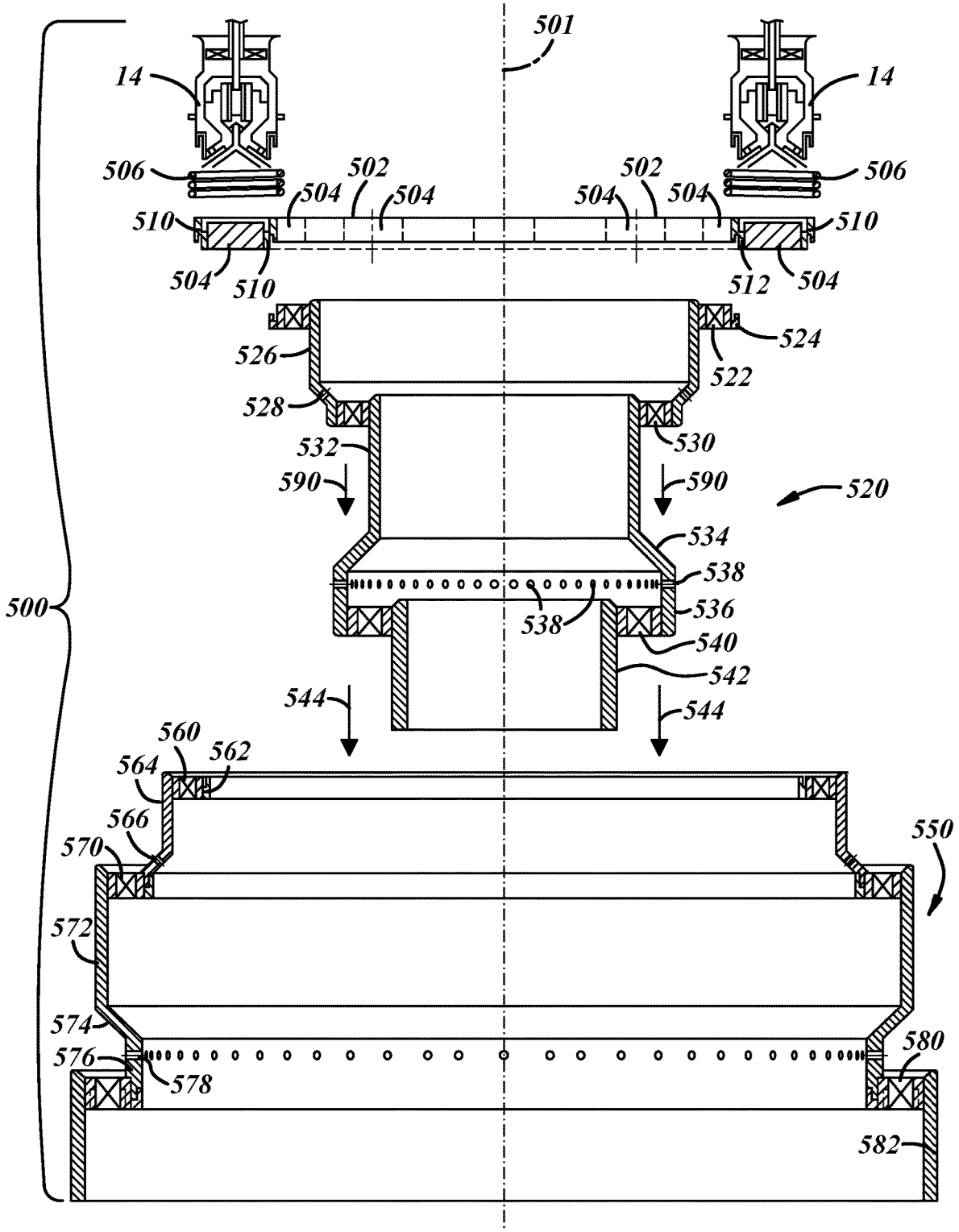
FIG. 10 is an exploded view of an annular combustor.

Referring to FIG. 10, an exploded view of an annular combustor 500 is shown in cross section. Injector annulus 502 is shown with multiple holes 504 to accommodate injectors 14. Only two injectors 14 are shown for the sake of clarity. Between injector 14 and injector annulus 502 are mechanical springs 506, which will be discussed below. Injector annulus 502 includes connectors or clips 510 (outer) and 512 (inner).

Annular combustor 500 has an inner liner 520 and an outer liner 550. The combustion occurs between liners 520 and 550. Inner liner 520 has a first cylindrical portion 526 coupled to a first frustum portion 528. At one end of first cylindrical portion 526 is a first swirler 522. On the outer edge of first swirler 522 is a connector 524 that engages with coupler 512 of injector annulus 502 when assembled. A second swirler 530 couples between an end of first frustum portion 528 away from the coupling with first cylindrical portion 526 and a second cylindrical portion 532. Second cylindrical portion 532 is affixed to a second frustum portion 534. First frustum portion decreases in diameter as considered in a direction from injector annulus 502 toward second swirler 530 (downstream) in contrast with second frustum portion 534 which increases in diameter as considered in the same downstream direction. The downstream end of second frustum portion 534 is coupled to a third cylindrical portion 536. In the embodiment in FIG. 10, a plurality of orifices 538 are provided around the circumference of third cylindrical portion 536. A third swirler 540 is installed between an inner surface of third cylindrical portion 536 and an outer surface of a fourth cylindrical portion 542.

Inner liner 520 is inserted into an outer liner 550. Outer liner 550 includes a swirler 560 on the inner surface of a first cylindrical portion 564 of outer liner 550. On the inner side of swirler 560 has a connector 562 that engages with connector 510 of injector annulus 502 when assembled. A first frustum portion 566 of outer liner 550 is coupled to a downstream end of first cylindrical portion 564 of outer liner 550. Between first cylindrical portion 564 and a second cylindrical portion 572 is a second swirler 570 of outer liner 500. Second cylindrical portion 572 is coupled to a second frustum 574 of outer liner 500. On the downstream end of second frustum 574, a third cylindrical portion 576 of outer liner 500 is coupled. Such third cylindrical portion 576 has a plurality of orifices 578 defined therein circumferentially. Coupled to the downstream end of the third cylindrical portion 576 is a third swirler 580 of the outer liner 550. Coupled to the outside surface of the third swirler 580 is a fourth cylindrical portion 582 of outer liner 550.

Overall flow in combustor 500 is from injector annulus 502 toward cylindrical portion 582. Arrows 590 are shown to illustrate the flow from upstream to downstream. There are recirculation zones in which a portion of the flow rolls up and does not move in the downstream direction. However, the flow is generally flowing from upstream to downstream exiting through cylindrical portion 582.

Figure 11:
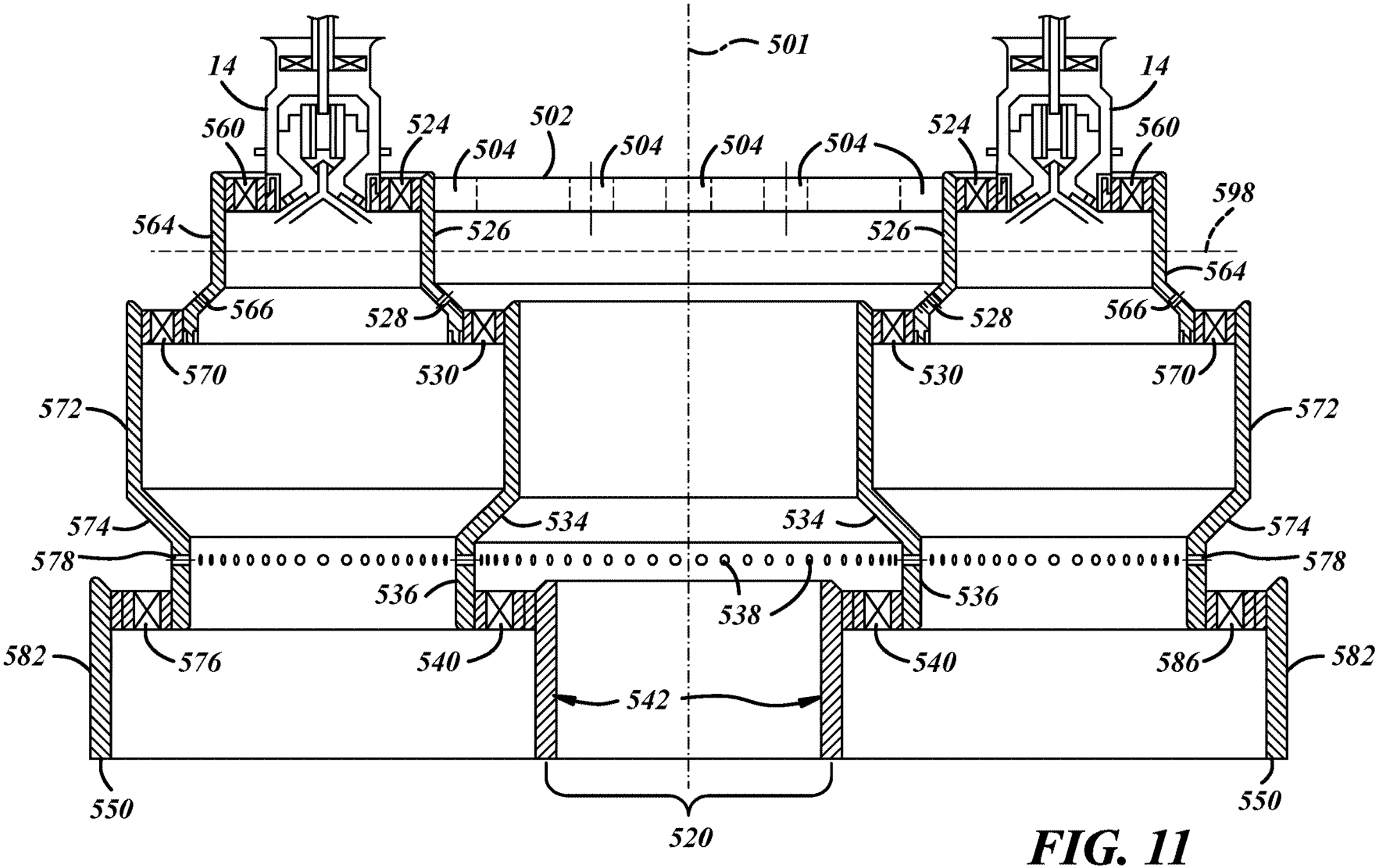
FIG. 11 is an assembled view of the annular combustor of FIG. 10.

Referring now to FIG. 11, inner liner 520 is inserted into outer liner 550. Only two injectors 14 are shown in the cross-sectional view in the interest of clarity. Injector annulus 502 shows five other holes that are provided to accept injectors.

Figure 12:
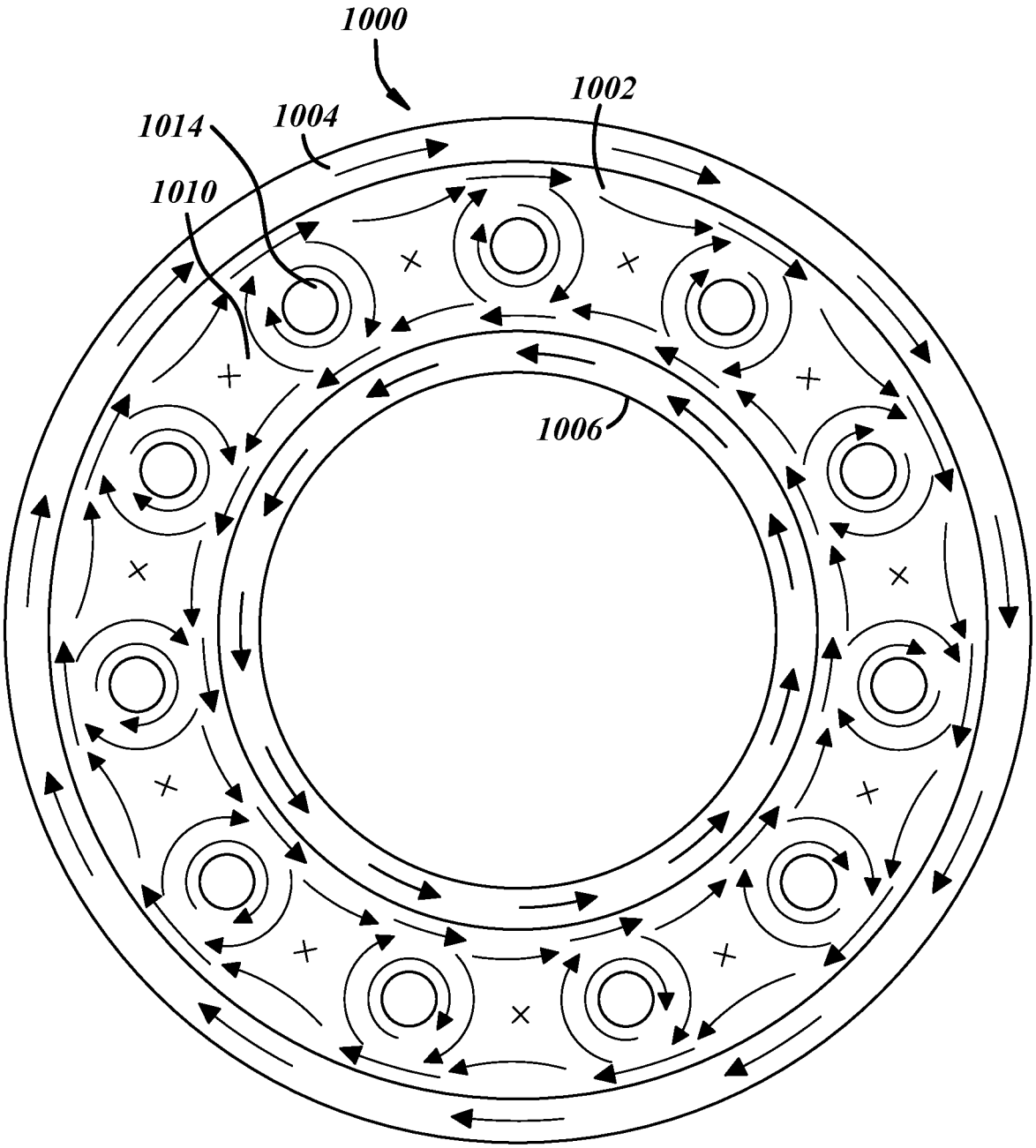
FIG. 12 is an illustration of flow in the annular prechamber as viewed toward the injectors situated in the injector annulus.

Before going further, an illustration in FIG. 12 shows the air flow at a cross section taken at dotted line 598 in FIG. 11. FIG. 12 is looking upward into the injector annulus 502 of FIG. 11. Annulus 1004 in FIG. 11 shows the flow that swirler 560 of FIG. 10 imparts to incoming flow, clockwise. Annulus 1006 in FIG. 11 shows the flow that swirler 524 imparts to incoming flow, counter clockwise. In some embodiments, injectors 1014 imparts swirling flow as shown as clockwise arrows around injectors 1014. The swirl at injectors 1014 is intensified by the swirls through annulus 1004 in a first sense and through annulus 1006 in a second sense. (The second sense is opposite to the first sense.) Areas between adjacent injectors 1014, areas such as 1010, are reasonably quiescent. Regardless, the areas in which the fuel is injected, i.e., near injectors 1014, have high mixture motion to aid in the mixing of the fuel and air. (An air inlet ring with deflectors to impart angular momentum to the air is called a swirler. The two terms are used interchangeably throughout.)

In FIG. 11, three pair of swirlers are shown: 524 and 560; 530 and 570; and 540 and 576. All of such swirlers are annular with centerlines coincident on center line 501. Swirlers associated with inner liner 520 (swirlers 524, 530, and 540) cause flow therethrough to rotate in a particular direction: either clockwise or counterclockwise. Swirlers associated with outer liner 550 (swirlers 560, 570, and 576) cause flow therethrough to rotate in the direction opposite that of swirlers 524, 530, and 540. Such counter flow intensifies the swirl that is imparted by injectors 14. (Herein, the rotational direction is also referred to as rotational sense.)

Figure 13:
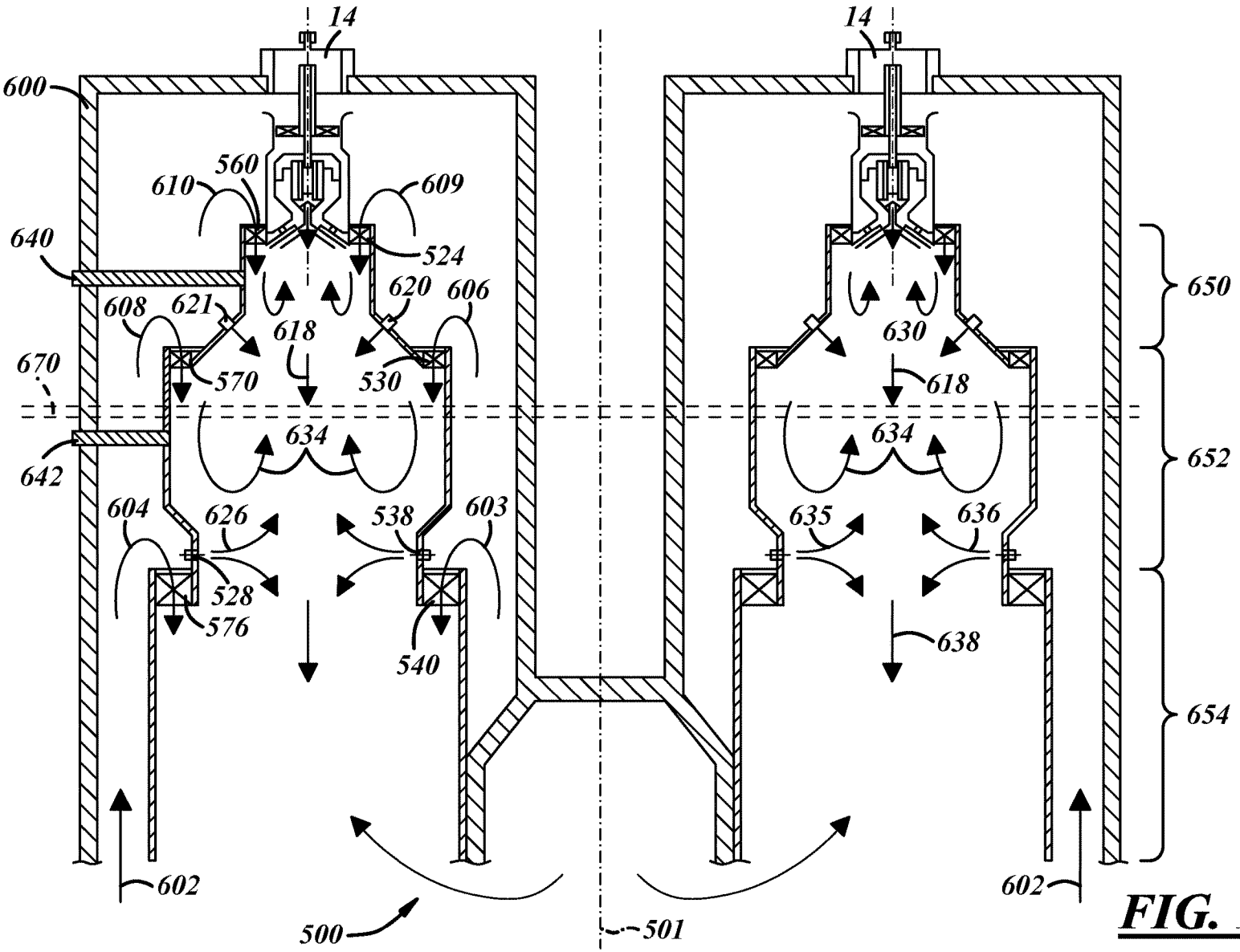
FIG. 13 is an illustration of a slice of the annular combustor with its associated housing as taken through two diametrically opposed injectors.

Referring now to FIG. 13, combustor 500 is shown within a housing 600 (or alternatively called combustor case). The view in FIG. 3 is a slice, as opposed to a cross-section, through combustor 500 and housing 600 as taken through two injectors 14 of the total of twelve. Inlet air is inducted into combustor 500 in passages that are defined by the inner surface of housing 600 and an outer surface of the outer liner. Outer liner is not separately called out in FIG. 13; yet is more easily discerned in the exploded view in FIG. 10 in which the outer liner is separately called out as element 550. Also discernable in FIG. 10 is inner liner 520. For the sake of clarity, these elements are not separately provided the numerals in FIG. 13. Air is also inducted into combustor 500 in passages defined by the inner surface of housing 600 and the inner surface of inner liner 520 (see FIG. 10 for illustration of inner liner 520).

A prechamber section 650, a main chamber section 652, and a dilution zone section 654 are situated in combustor 500 as considered from upstream to downstream. Prechamber section 650, main chamber section 562, and dilution zone section 654 refer to the volume that is within combustor 500, i.e., between the inner surface of the outer liner and the outer surface of the inner liner. Arrows 618 and 638 show the overall flow within combustor 500. Due to the swirl set up by air inlet rings 560, 524, 530, 570, 576, and 540, some updraft, as shown by arrows 630 is set up. In FIG. 13, orifices 620 allow inlet air to jet into prechamber 650. In some embodiments, orifices 620 are arranged to intensify the swirling flow.

In main chamber 652, the swirling flow that has been developed due to air inlets 524, 560, 530, and 570 and orifices 620 causes an updraft in flow as shown by arrows 634. Updrafts 630 and 634 assist with mixing to promote complete combustion.

Additional air jets in through orifices 636 and in through air inlet rings 576 and 540 to promote additional swirling in dilution zone section 654.

Inlet air is shown entering housing 600 as shown by arrows 602. Air travels upward in housing 600 and is inducted into dilution zone section 654 through air inlet rings 576 and 540, as shown by arrows 603 and 604. Air is inducted through orifices 620, which is defined in the inner liner and orifices 621 defined in the outer liner.

Combustor 500 is provided with an ignitor 640, as shown in FIG. 13, which pierces the wall of the prechamber and an ignitor 642, which pierces the wall of the main chamber. In some embodiments, both ignitors 640, 642 are provided as one location may be better for ignition than the other at some ambient conditions and the other location is better for other ambient conditions. Or, in other embodiments, only one ignitor is used.

In FIG. 13, a slice 670, indicated by dashed lines, is taken through main chamber 652 of combustor 500. A planar view of combustor 500 as viewed through slice 670 is shown in FIG. 14.

Figure 14:
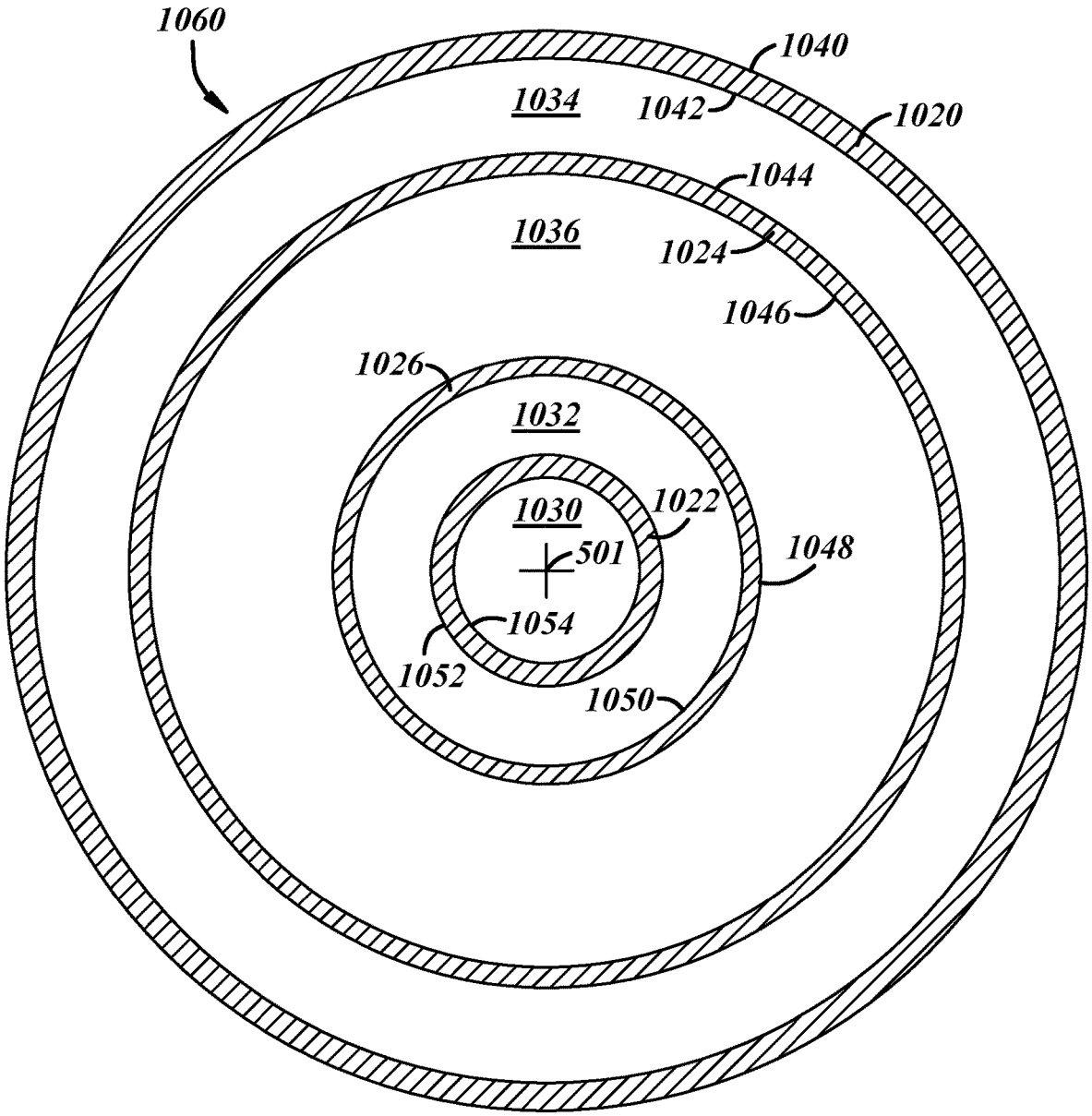
FIG. 14 shows a slice through the combustor's main chamber perpendicular to the center line.

Centerline 501 of FIG. 13 appears as a point 501 in FIG. 14. An outer wall 1020 of the housing has an outer surface 1040 and an inner surface 1042. An inner wall 1022 of the housing has an outer surface 1052 and an inner surface 1054. The particular cut through FIG. 13, i.e., dashed line 670, passes through main chamber 652. An outer liner portion 1024 partially defines main chamber of the combustor. Outer liner portion 1024 has an outer surface 1044 and an inner surface 1046. The main chamber of the combustor is further defined by an inner liner portion 1026 which has an outer surface 1048 and an inner surface 1050.

Inner surface 1042 of outer wall 1020 of the housing and outer surface 1044 of inner liner portion 1024 defines an air inlet passage 1034. Additionally, inner surface 1050 of inner liner portion 1026 and outer surface 1052 of inner wall 1022 of the housing define an air inlet passage 1032. Main chamber 652, which is annular, is shown as 1036 in FIG. 14. Main chamber 1036 is defined by inner surface 1046 of outer liner portion 1024 and outer surface 1048 of inner liner portion 1026. Within inner surface 1054 of inner wall 1022 of the housing is not part of the combustor.

Similar cuts through combustor 500 through prechamber 650 and dilution zone 654 of FIG. 13 would also show that prechamber 650 and dilution zone 654 are also annular like main chamber 652.

The combustor in any of FIGS. 1-3 and FIGS. 10, 11, and 13 may be operated in two modes: lower output and high output. As is well-known by those skilled in the art, to avoid producing nitrogen oxides (NOx) from combustion, it is important to operate away from a stoichiometric air-fuel ratio. Peak NOx formation occurs just lean of stoichiometric. In the lower output mode, the prechamber is operated lean enough of stoichiometric to avoid the high NOx formation condition. Air flows rates are lessened to ensure that the resulting ratio, although lean, is stably combustible, i.e., avoid flame out. No meaningful amount of combustion occurs in the main chamber and dilution zone. The exhaust products are further diluted in both the main chamber and the dilution zone. In the higher output mode, the prechamber is operated rich of stoichiometric. Because there is not enough air to burn the fuel, the combustion products from the prechamber includes CO, unburned hydrocarbons, and partially burned hydrocarbons. The desire is that these combustibles burn to completion in the main chamber. By diluting the exhaust products from the prechamber (via air coming in through orifices and an air inlet ring), the stoichiometry from the prechamber, which is rich of stoichiometric, quickly passes through stoichiometric and mixes out to a lean stoichiometry. With sufficient air, CO and incompletely burned hydrocarbons almost completely combust.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. An annular combustor, comprising:

an injector annulus with a plurality of holes defined therein;

a plurality of injectors, one of the plurality of injectors inserted into each of the plurality of holes in the injector annulus;

a first air inlet ring coupled between an inner surface of the injector annulus and an inner liner; and a second air inlet ring coupled between an outer surface of the injector annulus and an outer liner wherein:

the first air inlet ring has a plurality of deflectors that direct a flow of air passing therethrough to swirl in a first rotational direction;

the second air inlet ring has a plurality of deflectors that direct a flow of air passing therethrough to swirl in a second rotational direction opposite to the first rotational direction of the first air inlet ring;

an annular prechamber is defined by a prechamber portion of the inner liner and a prechamber portion of the outer liner;

the prechamber portion of the inner liner comprises a first cylindrical wall with a first frustum coupled to a downstream end of the first cylindrical wall;

a diameter of the first frustum decreases in a downstream direction;

the prechamber portion of the outer liner comprises a second cylindrical wall with a second frustum coupled to a downstream end of the second cylindrical wall;

a diameter of the second frustum increases in the downstream direction;

an annular main chamber is located downstream of the annular prechamber;

the annular main chamber is defined by a main chamber portion of the inner liner and a main chamber portion of the outer liner;

a third air inlet ring is coupled between the prechamber portion of the inner liner and the main chamber portion of the inner liner, having a plurality of deflectors that direct a flow of air passing therethrough to swirl in the first rotational direction; and a fourth air inlet ring is coupled between the prechamber portion of the outer liner and the main chamber portion of the outer liner, having a plurality of deflectors that direct a flow of air passing therethrough to swirl in the second rotational direction opposite the first rotational direction.

2. The annular combustor of claim 1, wherein a volume included between the inner liner and the outer liner comprises:

the annular prechamber located downstream of the plurality of injectors;

the annular main chamber located downstream of the annular prechamber; and an annular dilution zone located downstream of the annular main chamber.

3. The annular combustor of claim 1, further comprising:

a first plurality of orifices defined in the first frustum arranged evenly around a circumference of the first frustum; and a second plurality of orifices defined in the second frustum arranged evenly around a circumference of the second frustum.

4. The annular combustor of claim 1, wherein:

the main chamber portion of the inner liner comprises a third cylindrical wall with a third frustum coupled to a downstream end of the third cylindrical wall;

a diameter of the third frustum increases in the downstream direction;

the main chamber portion of the outer liner comprises a fourth cylindrical wall with a fourth frustum coupled to a downstream end of the fourth cylindrical wall; and a diameter of the fourth frustum decreases in the downstream direction.

5. The annular combustor of claim 4, wherein:

the main chamber portion of the inner liner further comprises a fifth cylindrical wall coupled to a downstream end of the third frustum;

the main chamber portion of the outer liner further comprises a sixth cylindrical wall coupled to a downstream end of the fourth frustum;

a first plurality of orifices is defined in the third frustum and arranged evenly around a circumference of the third frustum; and a second plurality of orifices is defined in the fourth cylindrical wall and arranged evenly around a circumference of the fourth cylindrical wall.

6. The annular combustor of claim 1, wherein:

the inner liner has the prechamber wall portion, the main chamber wall portion, and a dilution zone wall portion;

the outer liner has the prechamber wall portion, the main chamber wall portion, and a dilution zone wall portion; and an annular dilution zone of the annular combustor is defined by an outer surface of the dilution zone wall portion of the inner liner and an inner surface of the dilution zone wall portion of the outer liner, the annular combustor further comprising:

a fifth air inlet ring coupled between the main chamber wall portion of the inner liner and the dilution zone wall portion of the inner liner; and a sixth air inlet ring coupled between the main chamber wall portion of outer liner and the dilution zone wall portion of the outer liner.

7. The annular combustor of claim 6, wherein:

a downstream section of the annular prechamber increases in cross-sectional area in the downstream direction;

a downstream section of the annular main chamber decreases in cross-sectional area in the downstream direction;

a first plurality of circumferentially-arranged orifices is defined in the prechamber wall portions of the inner and outer liners; and a second plurality of circumferentially-arranged orifices is defined in the main chamber wall portions of the inner and outer liners.

8. The annular combustor of claim 6, further comprising:

an annular combustor housing having a plurality of openings in which the plurality of injectors are positioned wherein:

the inner and outer liners are mounted within the annular combustor housing;

passages are provided for incoming inlet air; and the passages are defined by inner surfaces of the annular combustor housing and inner surfaces of the inner liner and are defined by inner surfaces of the annular combustor housing and outer surfaces of the outer liner.

9. The annular combustor of claim 6, further comprising;

a mechanical spring disposed between each injector and the injector annulus.

10. The annular combustor of claim 2, further comprising:

a connector coupled to a downstream edge of the prechamber that mates with a connector coupled to an upstream edge of the main chamber; and a connector coupled to a downstream edge of the main chamber that mates with a connector coupled to an upstream edge of the dilution zone.

11. The annular combustor of claim 1, wherein the plurality of deflectors of the first air inlet ring, the plurality of deflectors of the second air inlet ring, the plurality of deflectors of the third air inlet ring or the plurality of deflectors of the fourth air inlet ring are each one of blades and orifices with a centerline of the orifices canted with respect to a centerline of the annular combustor.

12. An annular combustor, comprising:

an injector annulus with a plurality of holes defined therein;

a plurality of injectors, one of the plurality of injectors inserted into each of the plurality of holes in the injector annulus;

an annular prechamber located downstream of the injector annulus, the annular prechamber being defined between an inner liner and an outer liner;

an annular main chamber located downstream of the annular prechamber, the annular main chamber being defined between the inner liner and the outer liner;

a first air inlet ring coupled between an inner surface of the injector annulus and an outer surface of a portion of the inner liner at the annular prechamber;

a second air inlet ring coupled between an outer surface of the injector annulus and an inner surface of a portion of the outer liner at the annular prechamber;

a third air inlet ring coupled between an inner surface of the inner liner at the annular prechamber and an outer surface of a portion of the inner liner at the annular main chamber; and a fourth air inlet ring coupled between an outer surface of the outer liner at the annular prechamber and an inner surface of a portion of the outer liner at the annular main chamber wherein:

the first and third air inlet rings each have a plurality of deflectors that direct respective flows of air passing therethrough to swirl in a first rotational direction; and the second and fourth air inlet rings have a plurality of deflectors that direct respective flows of air passing therethrough to swirl in a second rotation direction opposite to the first rotational direction of the first and third air inlet rings.

13. The annular combustor of claim 12, further comprising:

a plurality of orifices defined in the inner liner at the annular prechamber;

a plurality of orifices defined in the outer liner at the annular prechamber;

a plurality of orifices defined in the inner liner at the annular main chamber; and a plurality of orifices defined in the outer liner at the annular main chamber.

14. The annular combustor of claim 12, further comprising:

an annular combustor housing having a plurality of openings in which the plurality of injectors are positioned wherein:

the inner and outer liners are mounted within the annular combustor housing;

passages are provided for incoming inlet air; and the passages are defined by inner surfaces of the annular combustor housing and inner surfaces of the inner liner and are defined by outer surfaces of the annular combustor housing and outer surfaces of the outer liner.

15. The annular combustor of claim 12, wherein:

the annular combustor further includes an annular dilution zone located downstream of the annular main chamber;

the inner liner comprises: an inner prechamber wall that partially defines the annular prechamber, an inner main chamber wall that partially defines the annular main chamber, and an inner dilution zone wall that partially defines the annular dilution zone; and the outer liner comprises: an outer prechamber wall that partially defines the annular prechamber, an outer main chamber wall that partially defines the annular main chamber, and an outer dilution zone wall that partially defines the annular dilution zone;

the inner prechamber wall comprises a first cylindrical wall with a first frustum coupled to a downstream end of the first cylindrical wall; and the outer prechamber wall comprises a second cylindrical wall with a second frustum coupled to a downstream end of the second cylindrical wall.

16. The annular combustor of claim 12, further comprising:

an annular dilution zone located downstream of the annular main chamber wherein:

the inner liner comprises: a portion at the annular prechamber, a portion at the annular main chamber, and a portion at the annular dilution zone;

the outer liner comprises: a portion at the annular prechamber, a portion at the annular main chamber, and a portion at the annular dilution zone;

the portion at the annular main chamber of the inner liner comprises a first cylindrical wall and a first frustum coupled to a downstream end of the first cylindrical wall;

the portion at the annular main chamber of the outer liner comprises a second cylindrical wall and a second frustum coupled to a downstream end of the second cylindrical wall; and an ignitor inserted into the annular combustor to access one of the annular main chamber and the annular prechamber.

17. The annular combustor of claim 16, further comprising:

a fifth air inlet ring disposed between an inner surface of the inner liner portion at the annular main chamber and an outer surface of a portion of the inner liner at the annular dilution zone; and a sixth air inlet ring coupled between an outer surface of the outer liner portion at the annular main chamber and an inner surface of a portion of the outer liner at the annular dilution zone wherein:

the fifth inlet ring has a plurality of deflectors that a direct flow of air passing therethrough to swirl in the first rotational direction; and the sixth air inlet ring has a plurality of deflectors that a direct flow of air passing therethrough to swirl in the second rotational direction opposite the first rotational direction of the first and third air inlet rings.

18. The annular combustor of claim 17, wherein: the plurality of deflectors of the first air inlet ring, the plurality of deflectors of the second air inlet ring, the plurality of deflectors of the third air inlet ring, the plurality of deflectors of the fourth air inlet ring, the plurality of deflectors of the fifth air inlet ring or the plurality of deflectors of the sixth air inlet ring, are each one of blades and orifices having a centerline that is canted with respect to a centerline of the annular combustor.

19. The annular combustor of claim 12, wherein:

the portion of the inner liner at the annular prechamber comprises a first cylindrical wall with a first frustum coupled to a downstream end of the first cylindrical wall;

a diameter of the first frustum decreases in a downstream direction;

the portion of the outer liner at the annular prechamber comprises a second cylindrical wall with a second frustum coupled to a downstream end of the first cylindrical wall;

a diameter of the second frustum increases in the downstream direction;

the portion of the inner liner at the annular main chamber comprises a third cylindrical wall with a third frustum coupled to a downstream end of the third cylindrical wall;

a diameter of the third frustum increases in the downstream direction;

the portion of the outer liner at the annular main chamber comprises a fourth cylindrical wall with a fourth frustum coupled to a downstream end of the fourth cylindrical wall; and a diameter of the fourth frustum decreases in the downstream direction.

* * * * *